US008003925B2

(12) United States Patent
Okada

(10) Patent No.: US 8,003,925 B2
(45) Date of Patent: Aug. 23, 2011

(54) INDUCTION HEATING COOKING APPARATUS

(75) Inventor: Kazuichi Okada, Hyogo (JP)

(73) Assignee: Panasonic Corporation, Osaka (JP)

( * ) Notice: Subject to any disclaimer, the term of this patent is extended or adjusted under 35 U.S.C. 154(b) by 207 days.

(21) Appl. No.: 12/065,705

(22) PCT Filed: Aug. 23, 2006

(86) PCT No.: PCT/JP2006/316494
§ 371 (c)(1),
(2), (4) Date: Mar. 4, 2008

(87) PCT Pub. No.: WO2007/029502
PCT Pub. Date: Mar. 15, 2007

(65) Prior Publication Data

US 2009/0194527 A1 Aug. 6, 2009

(30) Foreign Application Priority Data

Sep. 5, 2005 (JP) ..... 2005-255954

(51) Int. Cl.
*H05B 6/12* (2006.01)
*H05B 6/10* (2006.01)
*H05B 6/42* (2006.01)

(52) U.S. Cl. ..... 219/623; 219/632; 219/677

(58) Field of Classification Search ..... 219/620, 219/623, 624, 632, 677; 126/21 A, 21 R, 126/299 R, 299 D
See application file for complete search history.

(56) References Cited

U.S. PATENT DOCUMENTS

| | | | | |
|---|---|---|---|---|
| 4,899,028 | A * | 2/1990 | Arai et al. | 219/623 |
| 6,604,906 | B2 * | 8/2003 | Ozeki et al. | 415/204 |
| 2005/0103042 | A1 * | 5/2005 | Sanagi | 62/419 |

FOREIGN PATENT DOCUMENTS

| | | | |
|---|---|---|---|
| JP | 4-50305 | | 4/1992 |
| JP | 11-354264 | | 12/1999 |
| JP | 2001-208359 | | 8/2001 |
| JP | 2002110329 | A * | 4/2002 |
| JP | 2003100432 | A * | 4/2003 |
| JP | 2003-185157 | | 7/2003 |
| JP | 2004-281196 | | 10/2004 |
| JP | 2005-228585 | | 8/2005 |

OTHER PUBLICATIONS

International Search Report issued Oct. 31, 2006 in the International (PCT) Application of which the present application is the U.S. National Stage.
Patent Cooperation Treaty (PCT) International Preliminary Report on Patentability, issued Dec. 11, 2007.

* cited by examiner

*Primary Examiner* — Quang T Van
*Assistant Examiner* — Hung Nguyen
(74) *Attorney, Agent, or Firm* — Wenderoth, Lind & Ponack, L.L.P.

(57) ABSTRACT

Waste heat of a high temperature inside a main body is designed to be discharged to the outside of the main body by means of a discharge fan through a first suction air flow passage and a first discharge air flow passage. Also, through a second air flow passage communicating from a second discharge fan suction port to a discharge fan suction portion, air from the outside of the main body or air at a site of the main body, where the temperature is low, is sucked by a discharge fan so that the air of a low temperature can pass outside the drive motor to cool the latter. With this construction, the interior of the main body and the drive motor can be cooled efficiently.

15 Claims, 6 Drawing Sheets

Prior Art

INDUCTION HEATING COOKING APPARATUS

BACKGROUND OF THE INVENTION

I. Technical Field

The present invention relates to an induction heating cooking apparatus that has been incorporated in a cabinet such as, for example, a kitchen.

II. Description of Related Art

The cooking apparatus of this kind has hitherto been provided with a cooling fan and a discharge fan so that suction and discharge air flow passages can be forcibly defined to achieve efficient cooling of the apparatus (See, for example, Japanese Laid-open Patent Publication No. 11-354264 (JP '264)).

FIG. 7 illustrates the prior art induction heating cooking apparatus disclosed in JP '264. As shown in FIG. 7, an air intake fan 4 and a discharge fan 5 are provided within a main body 3. The main body includes a top plate 1 and an outer casing 2 integrated together, so as to forcibly define suction and discharge air flow passages, respectively, so that even though a pressure loss within the apparatus is substantial, air sucked through an air intake port 6 can be assuredly discharged through a discharge port 7 to thereby accomplish efficient cooling of the apparatus.

However, with the above-described prior art construction, problems have been found that air ready to be exhausted tends to be heated by a waste heat generated as a result of cooling a heat emitting area, including a heating chamber 8 and a heating coil (not shown) both within the main body 3, and a high temperate area including a shielding plate 9 and that since a drive motor for the discharge fan 5 is disposed in the discharge air flow passage and by the effect of the self-heating of the drive motor, particularly windings and bearings tend to be heated to such an extent as to make it difficult to suppress them to a temperature lower than the permissible temperature.

SUMMARY OF THE INVENTION

The present invention has been devised in view of those problems inherent in the prior art and is intended to provide an induction heating cooking apparatus, in which temperature rise of the drive motor, which is brought about as a result of the use of the discharge fan, can be suppressed and, also, in which the discharge fan can easily be installed inside the main body.

Means to Solve the Problems

In accomplishing the above objective, the present invention provides an induction heating cooking apparatus, which includes a top plate covering a top surface of a main body and forming a main body outer shell, at least one heating coil provided below the top plate, a discharge fan having a discharge fan suction portion and operable to discharge air inside the main body to the outside through a discharge port formed in the main body outer shell, and a drive motor for driving the discharge fan. A first air flow passage is provided to communicate between an interior of the main body and the discharge port, and accommodates the discharge fan therein. A second air flow passage is provided to communicate between a discharge fan suction port, into which air of a temperature lower than that of air sucked into the first air flow passage is sucked, and the discharge fan suction portion, and accommodates the drive motor therein. The discharge fan driven by the drive motor sucks the air, introduced into the first air flow passage and the second air flow passage, through the discharge fan suction portion, and cools the drive motor with the air discharged from the first air flow passage through the discharge suction portion after having been introduced from the discharge fan suction port into the second air flow passage and then flown past the drive motor.

Also, the first air flow passage includes a first suction air flow passage extending from a first air flow passage suction port defined inside the main body to the discharge fan suction portion.

The induction heating cooking apparatus further includes a discharge fan unit having a discharge fan casing that forms at least a part of the first air flow passage and accommodates the discharge fan therein, wherein the drive motor is fixed to the discharge fan casing, and the discharge fan unit is fixed to the main body. It is preferred that at least a portion of the second air flow passage be formed by the discharge fan casing.

Also, the first air flow passage is partitioned by a suction/evacuation partition plate into the first suction air flow passage and a first discharge air flow passage extending from the discharge fan suction portion to the discharge port, and an opening through which the first suction air flow passage and the first discharge air flow passage are communicated with each other is provided in the suction/evacuation partition plate. In such case, it is recommended to render the opening to be opposed to the discharge fan suction portion of a centrifugal type and to employ a motor-accommodating duct of a tubular configuration which defines the second air flow passage in a direction axially of the drive motor on a side adjacent the first discharge air flow passage.

Also, the discharge fan includes a boss engaged with a shaft of the drive motor, a flange connected with the boss, and a row of vanes provided in an outer peripheral portion of the flange. The flange has a flange opening in the vicinity of the boss for communicating between the discharge fan suction portion and the second air flow passage. In such case, it is preferred that the flange be so constructed as to have a recessed wall which is curved inwardly to represent the shape of a recess relative to the drive motor at a location inside a portion thereof where the row of vanes are formed so that the drive motor can be encased within the recessed wall.

Also, the flange protrudes towards the first suction air flow passage at a location proximate to the boss, and the boss is preferably so formed as to protrude towards the drive motor relative to the flange, so that the length of the boss which is situated within the second air flow passage can be increased.

The induction heating cooking apparatus may be of a type in which the main body is dropped into and then installed inside a cabinet having a top surface provided with an opening. In this case, the discharge port is formed in a top surface of the main body outer shell, and the discharge fan suction port is formed in an outer surface of the main body outer shell. The second air flow passage is operable to suck air inside the cabinet through the discharge fan suction port.

Also, the drive motor has the shaft lying horizontally, and the discharge fan suction port is preferably provided at a location above a bottom surface of the main body outer shell.

The discharge port is provided in a main body rear portion, and at least a portion of the discharge fan suction port is preferably provided at a position distant from a rearmost site of the main body outer shell rear surface.

The induction heating cooking apparatus further includes a heating chamber for heating a to-be-heated item accommodated therein, and a suction fan for sucking air from the outside of the main body. In this case, the discharge fan suction port is arranged at a location where air induced by the suction fan is sucked prior to the air reaching the heating chamber within the main body.

Effects of the Invention

The present invention having been so constructed as hereinbefore described brings about the following effects:

According to the present invention, waste heat of a high temperature within the main body is discharged forcibly by the discharge fan through the discharge port with the first air flow passage used as a flow path, thereby enhancing the cooling efficiency within the main body. At the same time, the drive motor for driving the discharge fan is cooled by the air introduced from the discharge fan suction port into the discharge fan suction portion through the second air flow passage without being exposed to the waste heat of the high temperature within the first air flow passage. Accordingly, the drive motor can be efficiently cooled when the position at which the discharge fan suction port is formed is selected to the position where the air can be drawn from a site within the main body, where the temperature of the air is low, or from the outside of the main body.

Also, if the first air flow passage includes the first suction air flow passage extending from the first air flow suction port, defined in the main body, to the discharge fan suction portion, the air in the vicinity of the first air flow passage suction port can be intensively sucked, and efficient cooling can be accomplished with the first air flow passage suction port provided at a site, where the cooling is necessitated, or where the air stagnates.

If a discharge fan unit is provided having a discharge fan casing that forms at least a part of the first air flow passage and accommodates the discharge fan therein, wherein the drive motor is fixed to the discharge fan casing and the discharge fan unit is fixed to the main body, incorporation of the first air flow passage and the drive motor into the main body and removal thereof at the time of repair can be facilitated.

Also, if at least a part of the second air flow passage is formed by the discharge fan casing, incorporation of the first air flow passage, the drive motor and the second air flow passage into the main body and removal thereof at the time of repair can be facilitated.

Also, the first air flow passage is partitioned by the suction/evacuation partition plate into the first suction air flow passage and the first discharge air flow passage, and the opening through which the first suction air flow passage and the first discharge air flow passage are communicated with each other is provided in the suction/evacuation partition plate. Further, the discharge fan suction portion of a centrifugal type is opposed to such opening, and a motor-accommodating duct of a tubular configuration which defines the second air flow passage is provided in a direction axially of the drive motor on a side adjacent the first discharge air flow passage. By so doing, the first discharge air flow passage and the suction air flow passage of the first air flow passage can be brought close to each other, and the first air flow passage can be thinned if a suction portion of the centrifugal discharge fan is opposed to a connection between the first suction air flow passage and the first discharge air flow passage. In addition, the provision of the tubular second air flow passage in the axial direction allows cooling wind to be introduced in a direction axially of the drive motor with a compact construction.

When the discharge fan is so constructed as to have the flange opening in the flange at a location proximate to the boss for communicating between the discharge fan suction portion and the second air flow passage, the flow inside the second air flow passage from the discharge fan suction port to the flange opening can be brought close towards a shaft surface of the drive motor and a bearing for the drive motor, thereby making it possible to lower the temperature of the motor shaft and that of the bearing at the root of the shaft.

Also, if the flange is so constructed as to have a recessed wall which is curved inwardly relative to the drive motor at a location inside a portion thereof where a row of vanes are formed so that the drive motor can be encased within the recessed wall, not only can the discharge fan be assembled thin, but due to the curved flange the second suction air flow passage can be made so as to follow the outer contour of the discharge fan for the drive motor and the shaft, thereby making it possible to enhance an effect of reducing the temperature of the motor shaft and that of the bearing at the shaft root. Also, the second suction air flow passage can easily follow the flange to enhance the effect of reducing the temperature of the discharge fan and, in addition, because of the flange having been curved, the flow resistance of the second suction air flow passage can be reduced to thereby suppress any reduction in performance of the discharge fan unit.

If the flange is so constructed as to protrude towards the first suction air flow passage at a location proximate to the boss, and the boss is so formed as to protrude towards the drive motor relative to the flange, the length of the boss which is situated within the second air flow passage can be increased, and a portion of the boss which is exposed to the air flowing inside the second air flow passage can be increased, thereby enhancing the effect of reducing the temperature of the shaft, engaged with the boss, and that of the bearing at the shaft root.

If the second air flow passage is so designed as to suck air inside a cabinet through the discharge fan suction port formed in an outer surface of the main body outer shell, air sucked through the discharge fan suction port and having a temperature lower than that of the discharge air in the cabinet can flow through the second air flow passage. Accordingly, not only can the temperature of the drive motor, the shaft, the discharge fan and so on be reduced, but also the heated air inside the cabinet can be sucked to thereby reduce the temperature inside the cabinet.

Also, if the drive motor has the shaft lying horizontally and the discharge fan suction port is provided at a location above a bottom surface of the main body outer shell, it is possible to prevent the discharge fan suction port from being closed or clogged with what has been accommodated within the cabinet. Further, since the discharge fan sucks the air inside the cabinet at a location above the bottom surface of the main body outer shell forming a storage space inside the cabinet, the temperature of the storage space can be lowered.

If the discharge port is provided in a main body rear portion and at least a portion of the discharge fan suction port is provided at a position distant from a rearmost site of the main body outer shell rear surface, even where the rear wall within the cabinet, into which the main body is incorporated, and the rearmost surface of the main body outer shell are positioned in proximity to each other, at least a part of the discharge fan suction port is separated from the rear wall of the cabinet, thereby making it possible to avoid the discharge fan suction port from being closed or clogged.

It is to be noted that if the space between the cabinet, into which the main body has been incorporated, and a main body outer shell surrounding is narrow, and the discharge fan suction port is provided in an outer surface of the main body outer shell, cases may occur, in which the discharge fan suction port is susceptible to clogging and/or in which in the presence of machines such as an oven evolving waste heat below the main body, cold air will be difficult to be sucked through the discharge fan suction port. In such cases, however, if the discharge fan suction port is arranged at a position where the air supplied by the suction fan can be sucked before it reaches the heating chamber inside the main body, the temperature of the air flowing through the second air flow passage can be maintained at a low temperature.

DETAILED DESCRIPTION OF THE INVENTION

Hereinafter, some preferred embodiments of the present invention will be described with reference to the accompanying drawings. It is to be noted that the present invention should not be limited to those embodiments.

Embodiment 1

Figure 1:
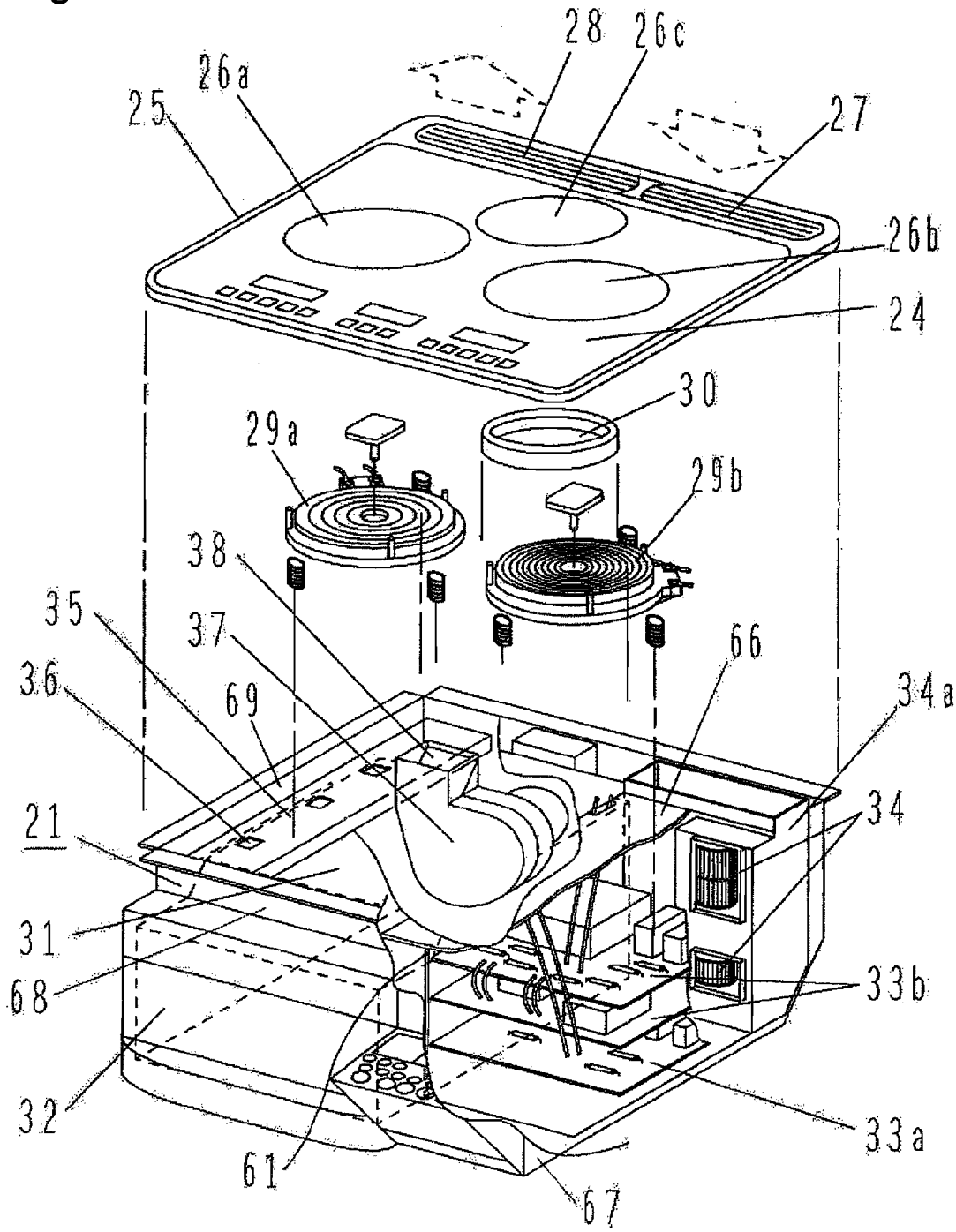
FIG. 1 is an exploded perspective view showing an induction heating cooking apparatus according to a first preferred embodiment of the present invention.
Figure 2:
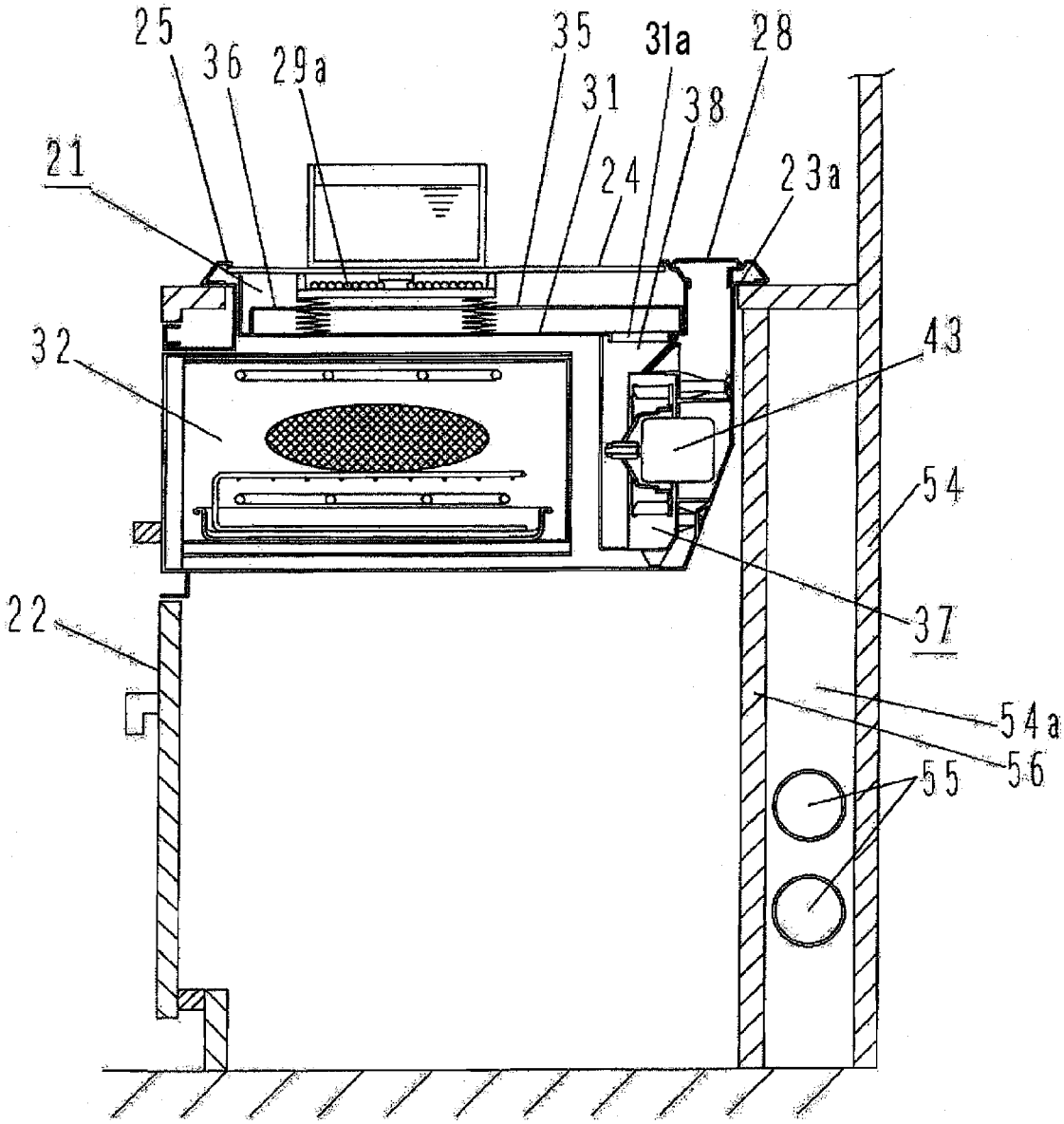
FIG. 2 is a longitudinal sectional view showing the induction heating cooking apparatus shown in FIG. 1.
Figure 3:
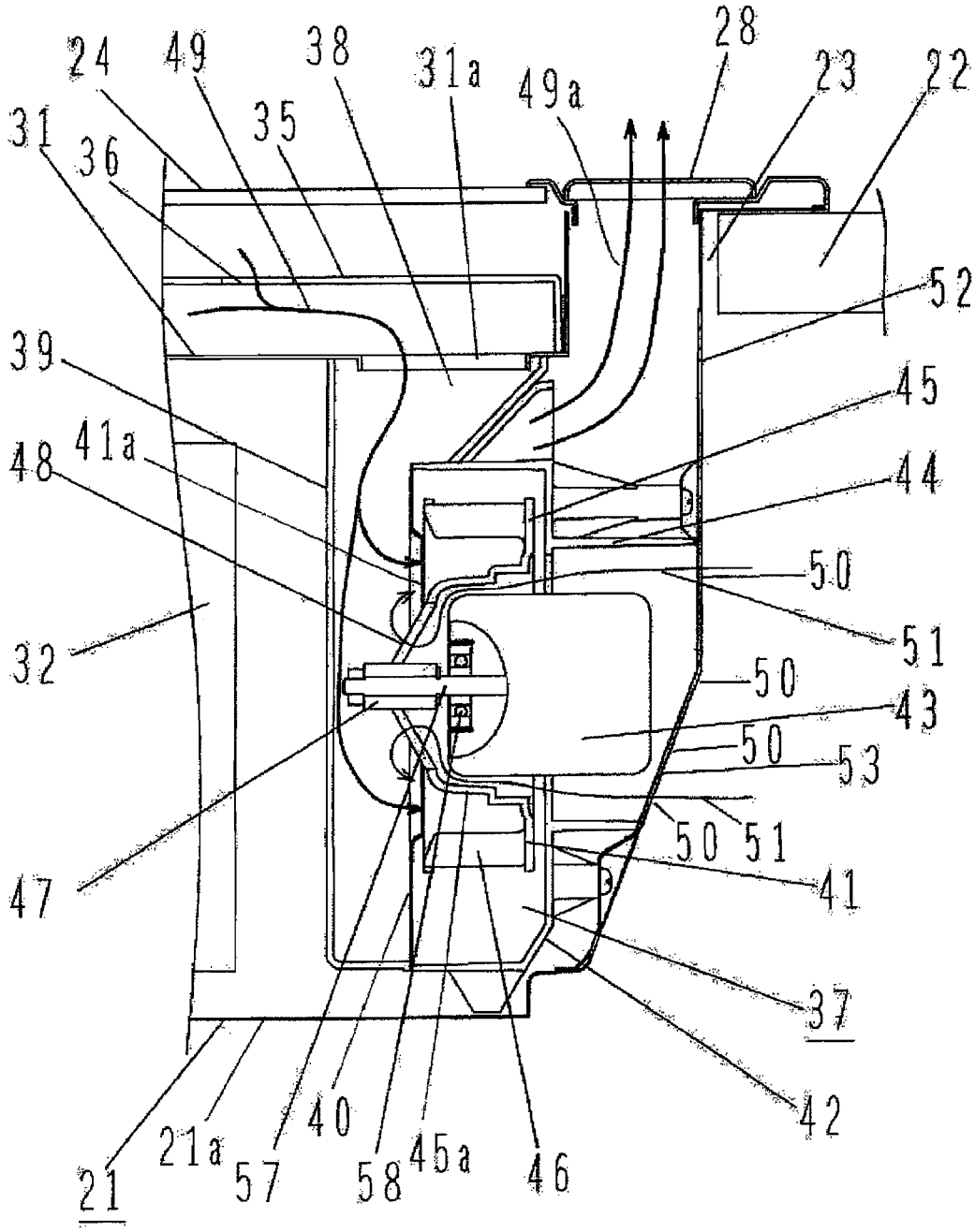
FIG. 3 is a fragmentary sectional view showing an important portion of the induction heating cooking apparatus shown in FIG. 1.
Figure 4:
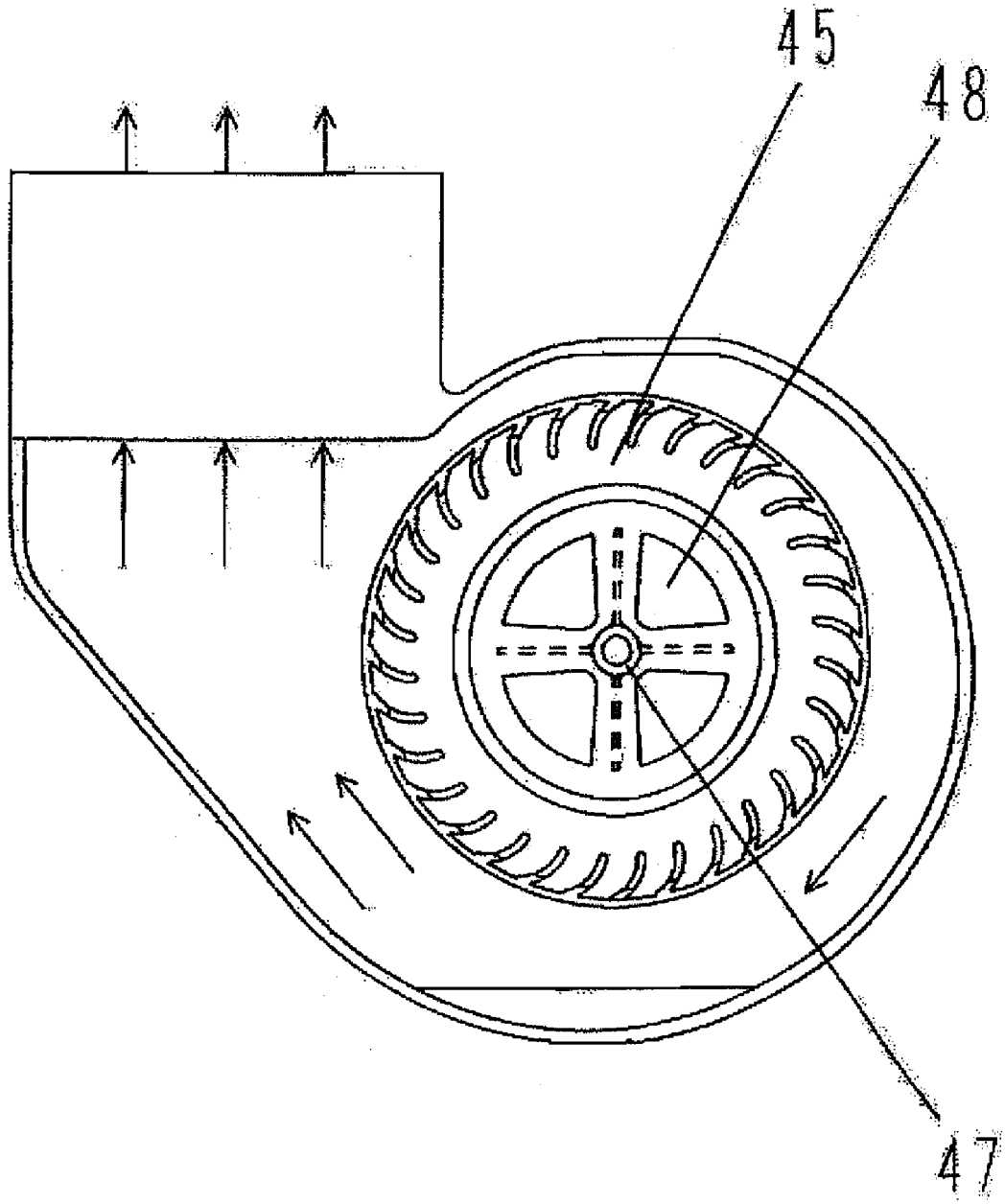
FIG. 4 is a fragmentary enlarged view showing the induction heating cooking apparatus shown in FIG. 1.

FIGS. 1 to 4 illustrate an induction heating cooking apparatus according to a first preferred embodiment of the present invention. FIG. 1 illustrates an exploded perspective view showing the construction of the induction heating cooking apparatus according to the first embodiment. FIG. 2 illustrates a longitudinal sectional view taken along a portion of a roaster 32. FIG. 3 illustrates a fragmentary sectional view showing an important portion of the induction heating cooking apparatus in the vicinity of a discharge fan unit 37. FIG. 4 illustrates a fragmentary enlarged view showing the discharge fan unit 37 as viewed from front with a suction guide (a discharge fan casing) 39 and a suction/evacuation partition plate 40 removed and shows the manner of flow of wind within a discharge fan casing 42.

Referring to FIGS. 1 to 3, a main body 21 of the cooking apparatus is dropped from above into and hence incorporated through an opening 23 defined in a top panel of a cabinet 22 of a kitchen. The main body 21 has its top surface covered by a top plate 24 made of crystallized ceramics that is surrounded with a plate frame 25. The top plate 24 is printed with heating areas 26*a*, 26*b* and 26*c* for visual indication thereof. A rear portion of the main body 21 rearwardly of the top plate 24 is provided with an air intake port 27 for introducing external air therethrough into the main body 21 and a discharge port 28 for exhausting air, which has been heated within the main body 21, to the outside. Heating coils 29*a* and 29*b*, which form respective parts of an induction heating means, and a radiant heater 30, which forms a part of an electric resistance heating means, are arranged within the main body 21 at respective locations aligned with the heating areas 26*a*, 26*b* and 26*c*, with the radiant heater 30 positioned rearwardly of the heating coils 29*a* and 29*b*.

The roaster 32, which forms a heating chamber for grilling, for example, fish, is arranged beneath the left heating coil 29*a* as shown by a dotted line in FIG. 1, and a partition plate 31 is provided as a shielding plate used so as to partition between them in a vertical direction to thereby make it difficult for heat, evolved by the roaster 32, to propagate upwardly. A gap for adiabatic purpose is provided between the partition plate 31 and a top area of the roaster 32. The heating coil 29*a* is mounted on the partition plate 31 through springs. An interior partition plate 61 is arranged laterally rightwards of the roaster 32 with a gap intervening between it and a right side surface of the roaster 32. The heating coil 29*a* is urged against a rear surface of the top plate 24 by means of the springs. A partition plate 66 is arranged at a level substantially flush with the partition plate 31 so as to partition above a space encompassed by a suction fan casing 34*a*, forming an outer shell for suction fans 34, the partition plate 61, a right side surface 67 of the outer shell of the main body, and a front surface 68 of the outer shell of the main body. The heating coil 29*b* is mounted on the partition plate 66 with springs intervening therebetween. The heating coil 29*b* is urged against the rear surface of the top plate 24 by means of the springs. A space delimited between the interior partition plate 61, positioned leftwards, and the partition plate 66 positioned above accommodates therein control circuits 33*a* and 33*b* in overlapped relation to each other.

As hereinabove described, the control circuits 33*a* and 33*b*, which form respective parts of electric supply circuits for the heating coils 29*a* and 29*b*, are arranged at a location rightwards of the roaster 32 and below the heating coil 29*b*. Two upper and lower suction fans 34 of a centrifugal type for sucking air from outside of the main body 21 are positioned rearwardly of the control circuits 33*a* and 33*b*.

As shown in FIGS. 1 to 3, a heat collecting duct 35 is arranged above the partition plate 31 so as to extend along the proximity of a left side surface 69 of the outer shell of the main body, which is remote from the suction fans 34, and has heat collecting openings 36 defined therein in dispersed relation to each other for sucking air which has been heated as a result of passage thereof through a space beneath the heating coil 29*a* adjacent the discharge port 28. A partition plate suction opening 31*a* is defined at a location rearwardly of the partition plate 31 and in the vicinity of the discharge port 28 and is provided within the heat collecting duct 35. A space inside the heat collecting duct 35 is communicated with the discharge port 28 through a first air flow passage (as will be described later) formed within the discharge fan unit 37 that is arranged within a space rearwardly of the roaster 32.

The discharge fan unit 37 is made up of a suction guide 39, a suction/evacuation partition plate 40, a discharge fan 41, a discharge fan casing 42, a drive motor 43 and a motor-accommodating tubular duct 44. The discharge fan 41 is in the form of a sirocco fan, which is one of centrifugal fans, and is of a structure including a flange 45 and a plurality of vanes 46 arranged on an outer peripheral portion of the flange 45 so as to extend perpendicular to the flange 45. The flange 45 has a cross-sectional shape including a recessed wall 45*a* positioned inside a portion, where the vanes 46 are formed, and recessed inwardly relative to the drive motor 43. The drive motor 43 is encased within the recessed wall 45*a* having been accommodated therein. The flange 45 is formed with a boss 47 for receiving therein a shaft 57 of the drive motor 43 for the discharge fan 41. A portion of the flange 45 adjacent the boss 47 has an opening 48 defined therein.

Heated air above the partition plate 31, which has passed through the heating coils 29*a* and 29*b* or the radiant heater 30 and has been subsequently guided from the heat collecting opening 36 to a first discharge fan suction port 38 through the heat collecting duct 35 and the partition plate suction opening 31*a*, is sucked by the discharge fan 41 after having passed the suction guide 39 and an opening defined in a central portion of the suction/evacuation partition plate 40. An air flow passage extending from the heat collecting opening 36 to a discharge fan suction portion 41*a* is referred to as a first suction air flow passage 49. Also, the air sucked by the discharge fan 41 is exhausted to the outside through an evacuated air flow passage, formed along an outer shell rear surface 52, by way of the discharge port 28. The air flow passage extending from the discharge fan suction portion 41*a* to the discharge port 28 is referred to as a first discharge air flow passage 49*a*, and a combination thereof with the first suction air flow passage 49 is referred to as a first air flow passage 49. On the other hand, an outer shell rear surface 52 of the main body 21 rearwardly of the drive motor 43 is provided with a plurality of second discharge fan suction ports 50. The air outside the main body 21 is sucked by the discharge fan 41 so as to flow through the second discharge fan suction ports 50, a gap defined between an outer surface of the drive motor 43 and the flange 45, and a flange opening 48, and then from the suction portion 41*a* of the discharge fan 41 that is opposite to the opening in the suction/evacuation partition plate 40. An air flow passage communicating between the second discharge fan suction ports 50 and the discharge fan suction portion 41*a* and having the drive motor 43 incorporated therein is defined so as to extend axially of the drive motor 43 and is referred to as a second air flow passage 51.

Air flowing through the second air flow passage 51 is the one introduced from the outside of the main body 21 and is sucked from interior of the cabinet 22 in which the main body 21 is incorporated. On the other hand, air flowing through the first suction air flow passage 49 is the air, which has been passed through and heated in touch with the heating coils 29*a* and 29*b* or the radiant heater 30. Accordingly, the air sucked through the second air flow passage 51 has a temperature lower than that of the air sucked through the first suction air flow passage 49.

The second air flow passage 51 has a cross-sectional area, which is smaller than that of the first air flow passage 49 as the second discharge fan suction ports 50 and the gap between the outer surface of the drive motor 43 and the flange 45 are constricted. Accordingly, the first air flow passage 40 serves as a primary air supply passage with a larger amount of air than that in the second air flow passage 51 flowing therethrough, whereas the second air flow passage 51 serves as an auxiliary air flow passage.

Although the discharge fan 41 is of a sirocco type, in which the vanes 46 are arranged perpendicular on the outer peripheral portion of the flange 45, not only is the drive motor 43 accommodated inside the row of the vanes 46, but also the flange 45 is so curved as to cover the outer surface of the drive motor 43, wherefore the drive motor 43 for the discharge fan 41 is enclosed within the thickness of the discharge fan 41 formed by the row of the vanes 46.

Also, with respect to the boss 47 relative to the flange 45, the flange 45 and the boss 47 are connected with each other so as to allow the boss 47 to protrude in a direction towards the drive motor 43, with a portion of the boss 47 positioned on the side of the second air flow passage 51, so that a substantial portion of the boss 47 can be exposed to the second air flow passage 51. Within the recessed wall 45*a* that is curved in the flange 45, the flange opening 48 is defined in a portion thereof adjacent the boss 47 mounted on the shaft 57 of the drive motor 43.

The cabinet 22, on which the main body 21 is mounted, has a top panel formed with an opening 23, through which the main body 21 is dropped onto the cabinet 22 when the main body 21 is to be mounted inside the cabinet 22. Since the second discharge fan suction port 50 is provided in the outer shell rear surface 52 of the main body 21, air inside the second air flow passage 51 is sucked from inside the cabinet 22 that is outside the main body.

The drive motor 43 for the discharge fan 41 is arranged substantially horizontally with the shaft 57 oriented in a direction forwards and rearwards. Since the drive motor 43 is so constructed as to be encompassed within the thickness of the discharge fan 41, the second discharge fan suction port 50 arranged rearwardly of the drive motor 43 is positioned in the outer shell rear surface 52 at a level higher than an outer shell bottom surface 21*a* of the main body 21.

A lower portion of the outer shell rear surface 52 of the main body 21 is formed as an inclined surface 53 as if the latter were to cut a corner of the contour of the main body, so that when at the time the main body 21 is installed within the opening 23 of the cabinet 22, the main body 21 can be inserted with the front side thereof oriented towards the cabinet 22 while a rear side thereof is turned, the main body 21 will not strike against the cabinet 22. Respective portions of the second discharge fan suction ports 50 are formed in the inclined surface 53 provided beneath the outer shell rear surface 52 of the main body 21.

FIG. 2 illustrates a sectional view of the main body 21 when the latter has been dropped and installed in the cabinet 22 through the opening 23 of the cabinet 22. As shown therein, in order to provide a space 54*a* at a position forwardly of a first rear wall 54 arranged adjacent a wall surface of a house so that conduits 55 for the flow of water and the passage of electric wirings, respectively, can be accommodated therein, a second rear wall 56 is provided forwardly of the first rear wall 54 with the space 54*a* defined therebetween, and a rear portion 23*a* of the opening 23 in the cabinet 22 and the second rear wall 56 are shown as brought in proximity with each other.

It is to be noted that in the drive motor 43, the shaft 57 is engaged in the boss 47 of the discharge fan 41 and, within the drive motor 43, the shaft 57 is supported by a bearing 58.

The operation and effects of the induction heating cooking apparatus so constructed as hereinbefore described will now be explained.

Air from the outside of the main body 21, which has been introduced by the suction fans 34 through the air intake port 27, first cools the control circuits 33*a* and 33*b*, and is then guided to above the partition plates 31 and 66 to cool the heating coils 29*a* and 29*b*. The discharge fan unit 37 operates in such a manner that the discharge fan 41 driven by the drive motor 43 draws the heated air, which has passed through the heating coils 29*a* and 29*b*, mainly through the first air flow passage 49 extending from the heat collecting opening 36 to the first discharge fan suction port 38 via the heat collecting duct 35 and the partition plate suction port 31*a*, and at the same time, draws air of a temperature lower than that of the air introduced through the first air flow passage 49 from the outside of the main body 21 through the auxiliary air flow passage, i.e., the second air flow passage 51 passing through the second discharge fan suction port 50.

In this way, separate from the first suction air flow passage 49 through which the heated air is sucked from the first discharge fan suction port 38, the air sucked into the second air flow passage 51 through the second discharge fan suction port 50 flows through the drive motor 43 for the discharge fan 41 and is sucked by the discharge fan 41. This construction can suppress a temperature rise of the drive motor 43 for the discharge fan 41, which is heated by the waste heat sucked from the first suction air flow passage 49 and by the effect of the self-heating, and, accordingly, any reduction in reliability such as, for example, damages to the drive motor 43 and/or lowering of the life time thereof can be remedied.

Also, since the second discharge fan suction port 50 and the discharge fan casing 42 accommodating the discharge fan 41 are connected with each other by means of the motor-accommodating duct 44, in which the drive motor 43 for the discharge fan 41 is accommodated, the air sucked through the second discharge fan suction port 50 by way of the second air flow passage 51 within the motor-accommodating duct 44 is assuredly sucked by the discharge fan 41 after having passed along the surface of the drive motor 43 and, therefore, the cooling performance of the drive motor 43 can be increased to thereby suppress the temperature rise of the drive motor 43, with the consequence that the lowering of the reliability such as, for example, damages to the drive motor 43 and/or reduction in life time can be further remedied.

Furthermore, since the flange 45 forming a part of the discharge fan 41 is provided with the flange opening 48 open so as to terminate in the vicinity of the boss 47 mounted on the drive motor 43 for the discharge fan 41, the air flowing through the second air flow passage 51 within the motor-accommodating duct 44, which is communicated with the second discharge fan suction port 50, flows through the flange opening 48 and is then sucked by the discharge fan 41 through the discharge fan suction portion 41*a*.

Accordingly, the flow through the second air flow passage 51 communicated from the second discharge fan suction port 50 to the flange opening 48 can be brought close towards the bearing 58 for the drive motor 43 and the surface of the shaft 57 and, therefore, the temperature of the shaft 57 of the drive motor 43 and the bearing 58 can be reduced.

Also, the discharge fan 41 is employed in the form of a sirocco type fan, in which the row of the vanes 46 are arranged on the outer peripheral portion of the flange 45, and the drive motor 43 is accommodated inside the row of the vanes 46 and the flange 45 is so curved as to cover the outer surface of the drive motor 43, so that the drive motor 43 for the discharge fan 41 may be encompassed within the thickness of the discharge fan 41 comprised of the row of the vanes 46.

Thus, since the drive motor 43 and the discharge fan 41 overlap one above other in a direction thicknesswise thereof, not only can the discharge fan unit 37 be assembled thin in structure, but also the use of the curved flange 45 can permit the second air flow passage 51 to easily follow the outer contour of the drive motor 43 and the shaft 57, allowing the effect of reducing the temperature of the shaft 57 of the drive motor 43 and the bearing 58 at the root of the shaft 57 to be enhanced. Also, the second air flow passage 51 can be easily made so as to follow the flange 45, and the discharge fan 41 can be designed to have a reduced temperature. Furthermore, the flow resistance in the second air flow passage 51 can be reduced as a result of the flange 45 having been curved, allowing the reduction in blowing performance of the discharge fan unit 37 to be suppressed. In addition, noises resulting from wind cutting sounds can also be reduced.

Yet, since relative to the flange 45 of the discharge fan 41, the flange 45 and the boss 47 are so connected with each other as to allow the boss 47, engaged with the shaft 57, to protrude in a direction towards the drive motor 43, with a portion of the boss 47 held on the side of the second air flow passage 51, the boss 47 can be exposed to the air flowing within the second air flow passage 51 before it reaches the flange opening 48 and, accordingly, an effect of reducing the temperature of the shaft 57, engaged in the boss 47, and the bearing 58 at the root of the shaft 57 can be further enhanced.

Again, the main body 21 is installed in the cabinet 22 having its top panel formed with the opening 23, the second discharge fan suction port 50 is provided in the outer shell rear surface 52 in the vicinity of the drive motor 43, and suction is made from the outside of the main body 21 to the second air flow passage 51.

Since the air flowing through the second air flow passage 51 is sucked from inside of the cabinet 22 through the second discharge fan suction port 50, the temperature of such air is lower than that of the air flowing through the first air flow passage 49, which is of a temperature near to that of the discharge air within the main body 21, which has been sucked through the first discharge fan suction port 38, making it possible to reduce the temperature of the discharge fan unit 37 and that of the drive motor 43, which is a component part thereof. Also, draw of the air within the cabinet 22 through the second discharge fan suction port 50 results in draw of heated air within the cabinet 22 and, accordingly, the temperature inside the cabinet 22 can be reduced.

Also, since with the shaft 57 of the drive motor 43 for the discharge fan 41 oriented transverse, the geometric center of the shaft 57 will not be oriented towards the outer shell bottom surface 21*a* of the main body 21, the second discharge fan suction port 50 can be formed in the outer shell rear surface 52 positioned above the outer shell bottom surface 21*a* of the main body 21. Accordingly, even where in a condition in which the main body 21 is installed in the cabinet 22, various items are accommodated in a space below the main body 21, which is a storage recess within the cabinet 22, and such space is full and/or film-like soft items such as, for example, thin papers or films are accommodated, there is no possibility that the second discharge fan suction port 50 will be closed or clogged easily. Yet, since the discharge fan unit 37 sucks the air inside the cabinet 22 at a position above the main body bottom surface 21*a*, which defines the storage recess inside the cabinet 22, the air flowing upwardly as the temperature becomes high is sucked and, accordingly, the temperature inside the storage recess in the cabinet 22 can be easily reduced.

In addition, the inclined surface 53, which is formed by cutting that corner at the bottom of the outer shell rear surface 52 of the main body 21, is provided with at least a portion of the second discharge fan suction port 50 (a generally half of the port 50 in the illustrated embodiment).

The cabinet 22, to which the induction heating cooking apparatus according to the foregoing embodiment is applied, is applicable where the interior rear wall 56 of the cabinet 22 at the rear portion 23*a* of the opening 23 is provided with a space forwardly of the first rear wall 54, arranged in the vicinity of the wall surface of the house, with the ducts 55 for accommodating water supply pipes and electric wirings accommodated within such space, and the rear portion 23*a* of the opening 23 in the cabinet 22 and the second rear wall 56 are positioned close to each other. In such case, the outer shell rear surface 52 is positioned close to the second rear wall 56, and the second discharge fan suction port 50 tends to be closed. However, since at least that portion of the second discharge fan suction port 50 is provided at a position removed from a rearmost surface of the main body outer shell, that is, in the inclined surface 53 positioned forwardly of the rearmost surface, at least that portion of the second discharge fan suction port 50 can be separated a distance from the rear wall of the cabinet. Accordingly, it is possible to avoid the possibility of the second discharge fan suction port 50 being closed or clogged, and the effect of cooling the drive motor 43, which is one of component parts forming the discharge fan unit 37, can be secured.

Embodiment 2

Figure 5:
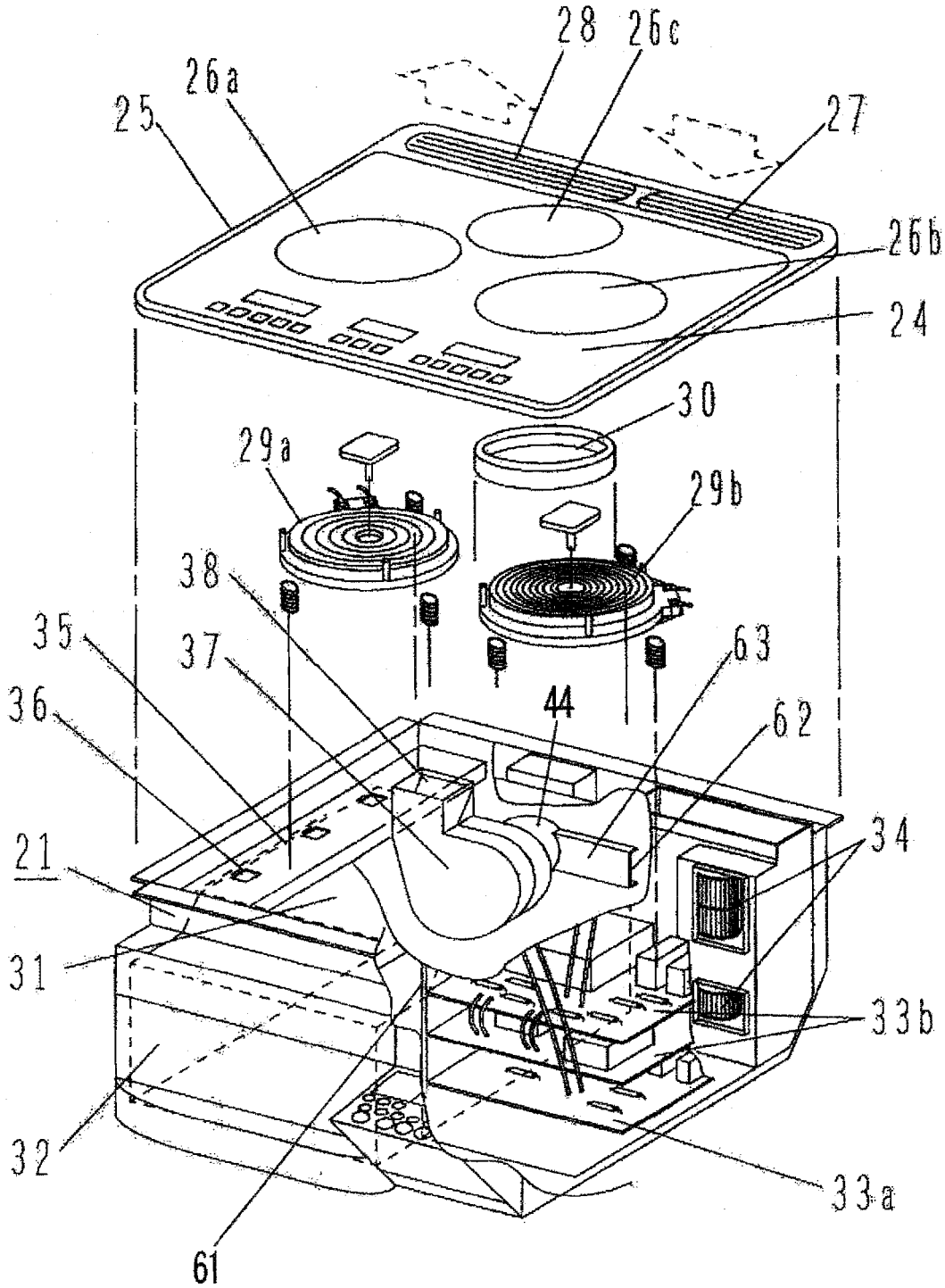
FIG. 5 is an exploded perspective view showing an induction heating cooking apparatus according to a second preferred embodiment of the present invention.
Figure 6:
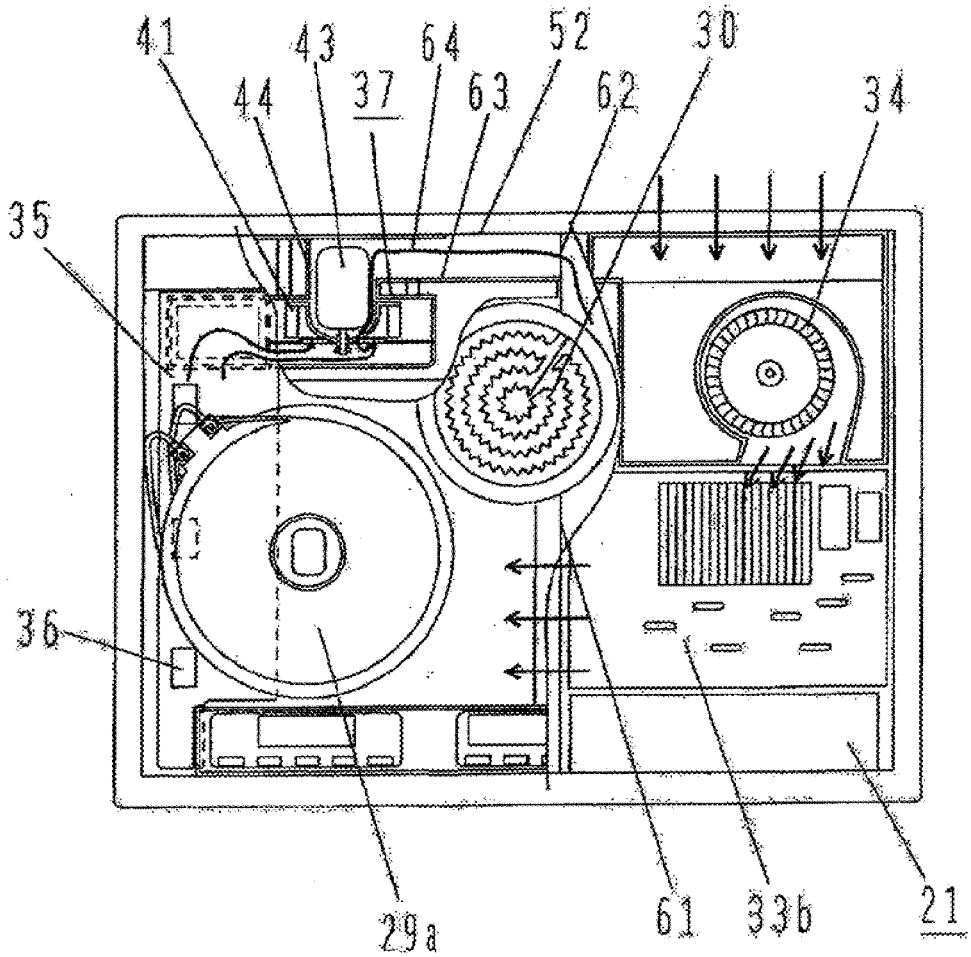
FIG. 6 is a horizontal sectional view showing the induction heating cooking apparatus shown in FIG. 5.
Figure 7:
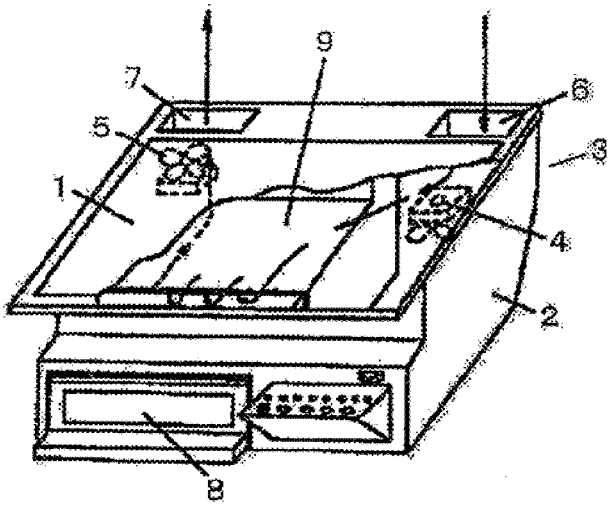
FIG. 7 is a longitudinal sectional view showing a prior art induction heating cooking apparatus.

FIGS. 5 and 6 illustrate an exploded perspective view of an induction heating cooking apparatus according to a second preferred embodiment of the present invention and a horizontal sectional view shown with the top plate 24 removed away, respectively.

The structure of each of the second discharge fan suction port 62 and the second air flow passage 64 is different from that shown and described in connection with the first embodiment, but other structures are similar to those employed in the first embodiment.

The interior partition plate 61 employed to secure a space for accommodating the control circuit 33*b* within the main body 21 is provided with the second discharge fan suction port 62 at a position proximate to the outer shell rear surface 52 at the rear of the radiant heater 30 and leftwardly of the suction fans 34. The second discharge fan suction port 62 and the motor-accommodating duct 44 are communicated with each other through an air intake duct 63, and air sucked by the discharge fan 41 flows within the air intake duct 63 to define the second air flow passage 64. The air intake duct 63 is provided in the outer shell rear surface 52 at a location rearwardly of the roaster 32, which is the heating chamber defined within the main body 21, with a space defined between it and the outer shell rear surface 52.

A flow of cooling air inside the second air flow passage 64 through the second discharge fan suction port 62 is branched in part towards an area below the radiant heater 30 so as to reach the second discharge fan suction port 62, while air sucked by the suction fans 34 from the outside of the main body 21 passes within the control circuit 33. A suction force caused by the discharge fan 41 communicated with the air intake duct 63 and the motor-accommodating duct 44 is generated in the second discharge fan suction port 62, and this forms the second air flow passage 64.

Air induced by the suction fans 34, positioned on a side of the suction port relative to the roaster 32, is directed towards the control circuit 33*b*, and a part thereof passes through the second air flow passage 64 to cool the drive motor 43 for the discharge fan 41 without reaching the heating coils 29*a* and 29*b* and the roaster 32.

Accordingly, the drive motor 43 operable to drive the discharge fan 41 for sucking the air, heated by heat evolved within the main body 21, and then discharging it to the outside of the main body 21 can suck, through the second air flow passage 64, the cooling air less susceptible to thermal influence depending on the presence or absence of the operation of the roaster 32, which is a heat emitting area, and, therefore, regardless of the use of the main body 21, a temperature rise of the drive motor can be suppressed.

As hereinbefore fully described, since the cooking apparatus according to the present invention is capable of discharging the air inside the main body to the outside through the discharge port to thereby accomplish cooling and of efficiently cooling the drive motor for driving the discharge fan while reducing the influences which may be brought about by the waste heat, it can be used as an induction heating cooking apparatus of an integration type that can be incorporated in a kitchen sink, and also as an induction heating cooking apparatus of a desk top type or a table mounting type, not only to increase the cooling performance within the main body, but also for the purpose of reducing the heated air around the main body.

The invention claimed is:

1. An induction heating cooking apparatus comprising:

a main body having a top surface;

a top plate covering the top surface of the main body and forming a main body outer shell, the main body outer shell having a discharge port formed therein;

at least one heating coil provided below the top plate;

a centrifugal discharge fan having a discharge fan suction portion configured to suck air therethrough and operable to discharge air inside the main body to outside through the discharge port formed in the main body outer shell, the centrifugal discharge fan comprising a boss, a flange connected to the boss, and a row of vanes disposed in an outer peripheral portion of the flange, the flange having a flange opening proximal to the boss;

a drive motor operable to drive the centrifugal discharge fan and having a shaft with which the boss of the centrifugal discharge fan engages;

a heat collecting duct accommodated within the main body and having a heat collecting opening formed therein, the heat collecting duct being configured and arranged such that air heated as a result of passage through the heating coil is sucked into the heat collecting duct through the heat collecting opening formed in the heat collecting duct;

a first air flow passage for communicating between the heat collecting duct and the discharge port and accommodating the centrifugal discharge fan therein; and a second air flow passage for communicating between a discharge fan suction port, into which air of a temperature lower than that of air sucked into the first air flow passage is sucked, and the discharge fan suction portion through the flange opening, the second air flow passage accommodating the drive motor therein on a side of the flange opposite to the row of vanes;

wherein the centrifugal discharge fan, when driven by the drive motor, sucks through the discharge fan suction portion air introduced into the first air flow passage and air introduced into the second air flow passage and having passed through the flange opening from a side of the drive motor to a side of the row of vanes, and cools the drive motor with the air discharged from the first air flow passage through the discharge suction portion after having been introduced from the discharge fan suction port into the second air flow passage and then flown past the drive motor.

2. The induction heating cooking apparatus as claimed in claim 1, wherein the first air flow passage includes a first suction air flow passage extending from a first air flow passage suction port defined inside the main body to the discharge fan suction portion.

3. The induction heating cooking apparatus as claimed in claim 1, further comprising a discharge fan unit having a discharge fan casing that forms at least a part of the first air flow passage and accommodates the discharge fan therein, wherein the drive motor is fixed to the discharge fan casing, and the discharge fan unit is fixed to the main body.

4. The induction heating cooking apparatus as claimed in claim 3, wherein the discharge fan casing forms at least a part of the second air flow passage.

5. The induction heating cooking apparatus as claimed in claim 1, wherein the main body is configured to dropped into and installed inside a cabinet having a top surface with an opening, wherein the discharge port is disposed in a top surface of the main body outer shell, and the discharge fan suction port is disposed in an outer surface of the main body outer shell, and wherein the second air flow passage is operable to suck air inside the cabinet through the discharge fan suction port.

6. The induction heating cooking apparatus as claimed in claim 5, wherein the drive motor has the shaft lying horizontally, and the discharge fan suction port is disposed at a location above a bottom surface of the main body outer shell.

7. The induction heating cooking apparatus as claimed in claim 5, wherein the discharge port is disposed in a main body rear portion, and at least a portion of the discharge fan suction port is disposed at a position distant from a rearmost site of the main body outer shell rear surface.

8. The induction heating cooking apparatus as claimed in claim 1, further comprising a heating chamber operable to heat a to-be-heated item accommodated therein, and a suction fan operable to suck air from outside of the main body, wherein the discharge fan suction port is arranged at a location where air induced by the suction fan is sucked prior to the air reaching the heating chamber within the main body.

9. An induction heating cooking apparatus comprising:

a main body having a top surface;

a top plate covering the top surface of the main body and forming a main body outer shell, the main body outer shell having a discharge port formed therein;

at least one heating coil provided below the top plate;

a centrifugal discharge fan having a discharge fan suction portion configured to suck air therethrough and operable to discharge air inside the main body to outside through the discharge port formed in the main body outer shell, the centrifugal discharge fan comprising a boss, a flange connected with the boss, and a row of vanes being disposed in an outer peripheral portion of the flange, the flange having a flange opening proximal to the boss;

a drive motor operable to drive the centrifugal discharge fan and having a shaft with which the boss of the centrifugal discharge fan engages;

a heat collecting duct accommodated within the main body and having a heat collecting opening formed therein, the heat collecting duct being configured and arranged such that air heated as a result of passage thereof through the heating coil is sucked into the heat collecting duct through the heat collecting opening formed in the heat collecting duct;

a first air flow passage for communicating between the heat collecting duct and the discharge port and accommodating the centrifugal discharge fan therein;

a second air flow passage for communicating between a discharge fan suction port, into which air of a temperature lower than that of air flowing through the first air flow passage is sucked, and a discharge fan suction portion through the flange opening, the second air flow passage accommodating the drive motor therein on a side of the flange opposite to the row of vanes;

a suction/evacuation partition plate for partitioning the first air flow passage into the first suction air flow passage and a first discharge air flow passage extending from the discharge fan suction portion to the discharge port, the suction/evacuation partition plate having an opening through which the first suction air flow passage and the first discharge air flow passage communicate with each other and which is opposed to the discharge fan suction portion; and a motor-accommodating duct of a tubular configuration which defines the second air flow passage in a direction axially of the drive motor on a side adjacent the first discharge air flow passage;

wherein when the drive motor drives the centrifugal discharge fan, air introduced from the discharge fan suction port into the second air flow passage, having passed through the flange opening from a side of the drive motor to a side of the row of vanes, and discharged from the first air flow passage through the discharge fan suction portion cools the drive motor.

10. The induction heating cooking apparatus as claimed in claim 9, wherein the flange has a recessed wall, the recessed wall being curved inwardly to represent the shape of a recess relative to the drive motor at a location inside a portion thereof where the row of vanes are formed so that the drive motor can be encased within the recessed wall.

11. The induction heating cooking apparatus as claimed in claim 9, wherein the flange protrudes towards the first suction air flow passage at a location proximate to the boss, and the boss protrudes towards the drive motor relative to the flange.

12. The induction heating cooking apparatus as claimed in claim 9, wherein the main body is configured to be dropped into and installed inside a cabinet having a top surface with an opening, wherein the discharge port is disposed in a top surface of the main body outer shell, and the discharge fan suction port is disposed in an outer surface of the main body outer shell, and wherein the second air flow passage is operable to suck air inside the cabinet through the discharge fan suction port.

13. The induction heating cooking apparatus as claimed in claim 12, wherein the drive motor has the shaft lying horizontally, and the discharge fan suction port is disposed at a location above a bottom surface of the main body outer shell.

14. The induction heating cooking apparatus as claimed in claim 12, wherein the discharge port is disposed in a main body rear portion, and at least a portion of the discharge fan suction port is disposed at a position distant from a rearmost site of the main body outer shell rear surface.

15. The induction heating cooking apparatus as claimed in claim 9, further comprising a heating chamber operable to heat a to-be-heated item accommodated therein, and a suction fan operable to suck air from outside of the main body, wherein the discharge fan suction port is arranged at a location where air induced by the suction fan is sucked prior to the air reaching the heating chamber within the main body.

* * * * *